United States Patent [19]

Meyer et al.

[11] Patent Number: 4,613,064

[45] Date of Patent: Sep. 23, 1986

[54] TILTING DISPENSER

[75] Inventors: Klaus Meyer, Neuss; Dieter vom Hofe, Cologne, both of Fed. Rep. of Germany

[73] Assignee: Henkel Kommanditgesellschaft auf Aktien, Duesseldorf, Fed. Rep. of Germany

[21] Appl. No.: 633,811

[22] Filed: Jul. 24, 1984

[30] Foreign Application Priority Data

Jul. 30, 1983 [DE] Fed. Rep. of Germany ..... 3327627

[51] Int. Cl.[4] ..... G01F 11/26

[52] U.S. Cl. ..... 222/456; 222/567

[58] Field of Search ..... 222/164, 166, 424.5, 222/425, 434, 438, 452, 454, 455–457, 305, 526, 556, 564, 566–567

[56] References Cited

U.S. PATENT DOCUMENTS

| | | | |
|---|---|---|---|
| 2,800,257 | 7/1957 | Nixon | 222/454 |
| 2,980,297 | 4/1961 | Tucci | 222/456 X |
| 3,221,951 | 12/1965 | Souza | 222/456 |
| 3,584,771 | 6/1971 | Wakamatsu | 222/457 |
| 4,201,320 | 5/1980 | Eppenbach | 222/456 |
| 4,346,823 | 8/1982 | Eppenbach | 222/443 |

FOREIGN PATENT DOCUMENTS

| | | | |
|---|---|---|---|
| 3120234 | 12/1982 | Fed. Rep. of Germany | 222/454 |

*Primary Examiner*—Joseph J. Rolla
*Assistant Examiner*—Michael S. Huppert
*Attorney, Agent, or Firm*—Ernest G. Szoke; Henry E. Millson, Jr.; Mark A. Greenfield

[57] ABSTRACT

A tilting dispenser for the measured release of a free-flowing solid. The dispenser comprises an enclosed chamber housing including an inlet opening, discharge outlet and a baffle located between the opening and the outlet. The baffle restricts the flow of the solid material when the dispenser is tilted in certain positions. Also, a coupling is provided for attachment to the outlet opening of the particular storage container to which it is to be fitted.

10 Claims, 10 Drawing Figures

TILTING DISPENSER

BACKGROUND OF THE INVENTION

1. Field of the Invention.

This invention relates to a dispenser for the measured release of a free-flowing substance from a tilted hand-held storage container, having no moving parts at the moment of its operation. p 2. Statement of the Related Art.

A tilting dispenser of this general type is described in German Patent Application No. 31 20 234 and corresponding European Patent Application No. 66,216. The device meters loose material from a container by allowing it first to fall into a pocket of given volume and then to leave the pocket. The material is delivered by first inverting the container 180° so that the device points downwards (the material enters the pocket). The container is then righted again (the material leaves the pocket and enters the throat 11 of the outlet 19). The container is then inverted for the second and last time (the material slides out along the outlet's throat and fresh material enters the pocket).

The pocket is defined by an extension 10 to one side of the outlet throat. A sloping wall 5 acts as a roof for the pocket and allows material to enter the pocket only from one side. The material passes from the pocket over the extension 10 into the throat.

Although this known dispenser may be used for dispensing fine granulates, the pack has to be tilted or turned upside down twice for dispensing. Not only does this complicate dispensing, but also the dispenser volume required is disproportionate in relation to the dispensed volume, because at least two compartments with the full dispensing volume are required inside the dispenser. The considerable dispenser volume may either be accomodated within the storage vessel or afforded as an attachment. In the first case, there is a considerable loss of filling volume, while in the second case the repacking required for shipping is expensive.

For the reasons explained above, the known tilting dispensers are used almost exclusively for dispensing small quantities, for example of sugar. For dispensing considerably larger quantities, for example of detergent powders, tilting dispensers have until now been regarded as unsuitable either because they required an unusually large dispensing head which could not be economically produced or because their use necessitated persistent repetition of the dispensing operation which was unappealing to the consumer.

SUMMARY OF THE INVENTION

The present invention provides a compact tilting dispenser with which a metered quantity of product required or determined in advance is dispensed in a single dispensing operation. The inventive metered dispenser is particularly useful for discharging a measured amount of a free-flowing solid, such as a powdered detergent, and is therefore particularly useful in connection with dishwashers and laundry washing machines.

A critical aspect of this invention is that there are no moving parts during its operation. The invention instead relies upon baffles of a particular configuration and the known flow characteristics of free-flowing solids.

In its broadest aspect, the inventive tilting dispenser comprises a chamber defined by a housing, a receiving passage at the bottom of the chamber, a discharge passage on one side of the chamber at about a 90° angle to the receiving passage, and a baffle of particular configuration between the two passages, which baffle restricts the flow of the solid material being dispensed, when the dispenser is tilted in certain positions.

More specifically, this invention affords a dispenser with a baffle preceding its inlet opening and an oblique sliding wall having an extension wall at the free end of the sliding wall which forms a substantially V-shaped web with the sliding wall. The baffle wall consists of a cover wall extending substantially perpendicularly to the central longitudinal axis of the container. There is also an end wall extending substantially parallel at an oblique angle to the sliding wall and an outlet passage which opens outwards between the baseplate of the dispenser and the end wall substantially at a right angle in relation to the central axis.

An essential feature of the dispenser of this invention is the positioning of the outlet passage substantially at a right angle to the central axis of the storage container. As a result, it is possible first to premeasure the product and then to dispense the premeasured quantity of product simply by tilting the storage container back through about 90°. This is in contrast to known tilting dispensers in which the outlet opening extends substantially parallel to the container axis. In other words, the quantity of product premeasured during turning of the container into the overhead (180°) position will be dispensed from the outlet passage during the first half of the return tilting movement.

The function is further improved if, starting from the cover wall, the oblique end wall extends so far that it projects materially through the notional (imaginary) radial plane through the free end of the extension wall. With the V-shaped web and the end wall mutually associated in this way, free-flowing products may be premeasured with particular accuracy in the overhead position of the dispenser. There is no danger of the dispensing chamber overflowing.

The outlet passage is in reality a substantially straight continuation of the gap formed between the free end of the V-shaped web and the end wall. Accordingly, the passage has a flat, substantially rectangular cross-section, at least at its inlet end. In order to enable the product to be dispensed under control, it is of advantage for the outlet passage to be tapered from its sides towards its outlet. The advantage of this is that the outlet passage may then terminate in a cylindrical outlet nozzle designed to receive a closure cap.

The dispenser according to the invention also advantageously comprises a coupling for attachment to the outlet opening of the particular storage container to which it is to be fitted. The coupling may be designed in accordance with the configuration of the orifice of the storage container. The closure facility may also be integrated into the region between the dispenser and the coupling providing the actual dispenser is mounted for rotation relative to the coupling about the central longitudinal axis of the container and providing openings which can be brought to coincidence by the relative rotation are provided in the top of the coupling and in the bottom of the dispenser.

Another advantage of the tilting dispenser of this invention is that the V-shaped web may be mounted for displacement toward the outlet passage substantially radially in relation to the central longitudinal axis of the container or dispenser and substantially parallel to the bottom of the dispenser. This is possible in principle because the tilting dispenser according to the invention requires only one metering chamber and not—as in known devices—two metering chambers of substantially the same size. Accordingly, the invention provides a tilting dispenser in which the dispensed volume may be adapted within wide limits to suit particular requirements, for example the hardness of the available water or the size of the load in the case of washing powder.

BRIEF DESCRIPTION OF THE DRAWINGS

Embodiments of the invention are described in detail in the following with reference to the accompanying diagrammatic drawings, wherein.

DETAILED DESCRIPTION OF THE INVENTION

Figure 1:
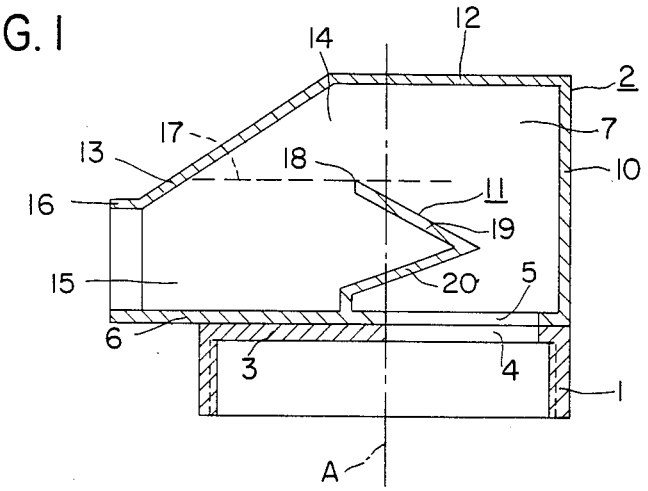
FIG. 1 is a section through a dispenser parallel to the central longitudinal axis of the container through I—I of FIG. 2.
Figure 2:
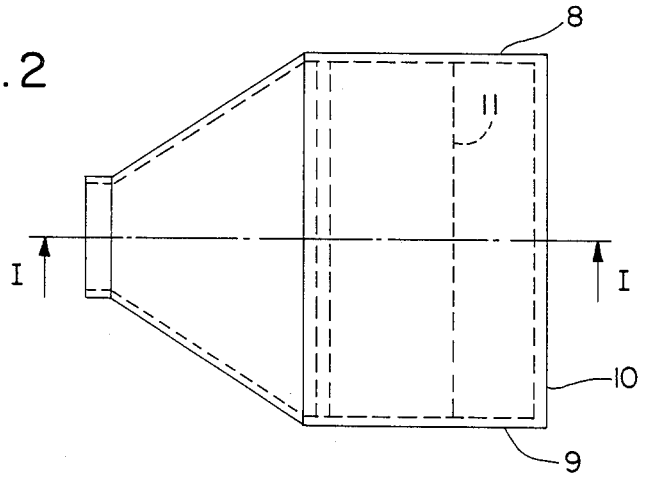
FIG. 2 is a plan view of the dispenser shown in FIG. 1 in the direction of the central axis.
Figure 3:
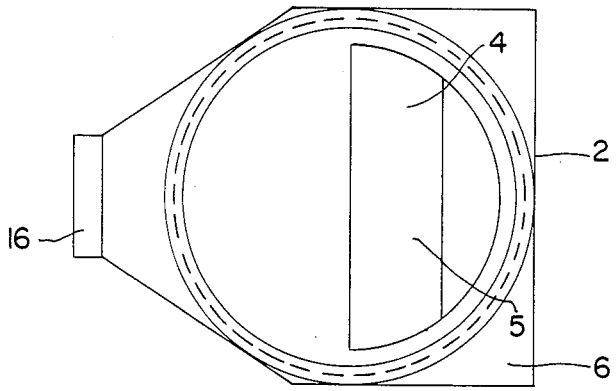
FIG. 3 is a view from beneath of the dispenser shown in FIG. 1 in the direction of the central axis.
Figure 1A:
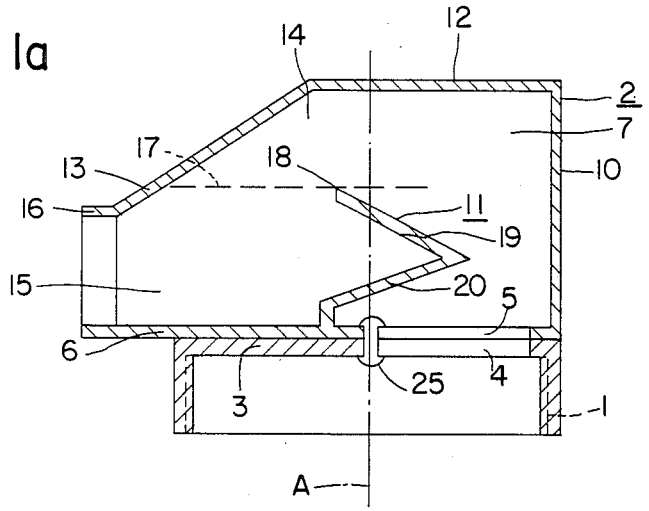
FIG. 1*a* is a section through a dispenser parallel to the central longitudinal axis of the container.
Figure 4:
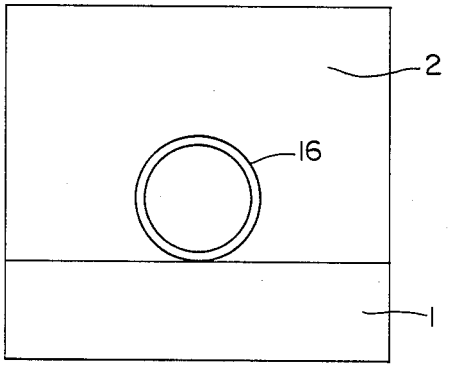
FIG. 4 is an elevation of the dispenser shown in FIG. 1 in the direction of the outlet nozzle.
Figure 3A:
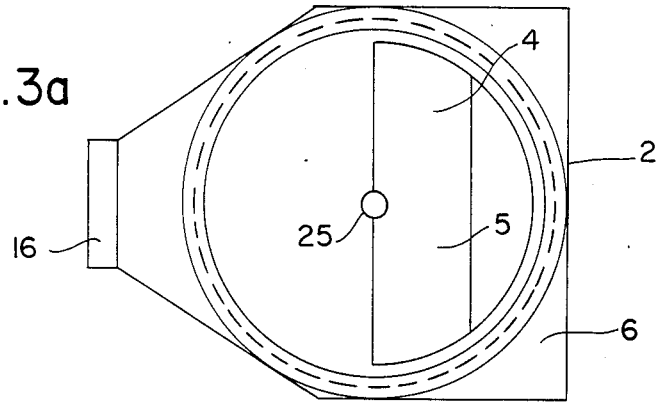
FIG. 3*a* is a view from beneath of the dispenser shown in FIG. 1*a* in the direction of the central axis.

The device shown in FIGS. 1 to 4 comprises a coupling (preferably a screw closure) 1 with the actual dispenser 2 secured thereto by bonding, welding, snap-fitting or the like. The embodiment illustrated in FIG. 1*a* and 3*a* shows the dispenser 2 attached to the closure 1 by a pivoted connection 25. In the coupling's head 3, the screw closure has an aperture 4, preferably semicular in shape, which corresponds to an identical opening 5 in the baseplate 6 of the dispenser 2. Where the dispenser 2 and the coupling 1 are mounted for relative rotation about the central longitudinal axis A of the container, the particular storage container coupled to the coupling 1 may be opened or closed by turning the dispenser 2 relative to the coupling 1.

The actual dispenser 2 comprises a housing or metering chamber 7 which, in the embodiment illustrated, is a rectangular solid defined by two side walls 8 and 9 extending parallel to one another (see FIG. 2), by a rear wall 10, by a V-shaped web 11 extending from the side wall 8 to the side wall 9, by a top wall 12 which faces the web 11 and which closes off the side and rear walls 8, 9, 10 at the head of the dispenser and an adjoining end wall 13. The end wall 13 slopes obliquely from the top wall 12 toward the baseplate 6 and, together with the the free edge 18 of the web 11, forms a dispensing passage 14 extending over the entire width of the compartment. The empty space 15 between the dispensing passage 14 and the outlet or outlet nozzle 16 may either be used to enlarge the metering chamber 7 by laterally shifting the V-shaped web 11 toward the outlet nozzle 16 or, alternatively, is designed to act as an outflow passage tapering toward the outlet nozzle 16. The outlet nozzle 16 is preferably a cylindrical projection suitable for receiving a closure plug (not shown).

Figure 5:
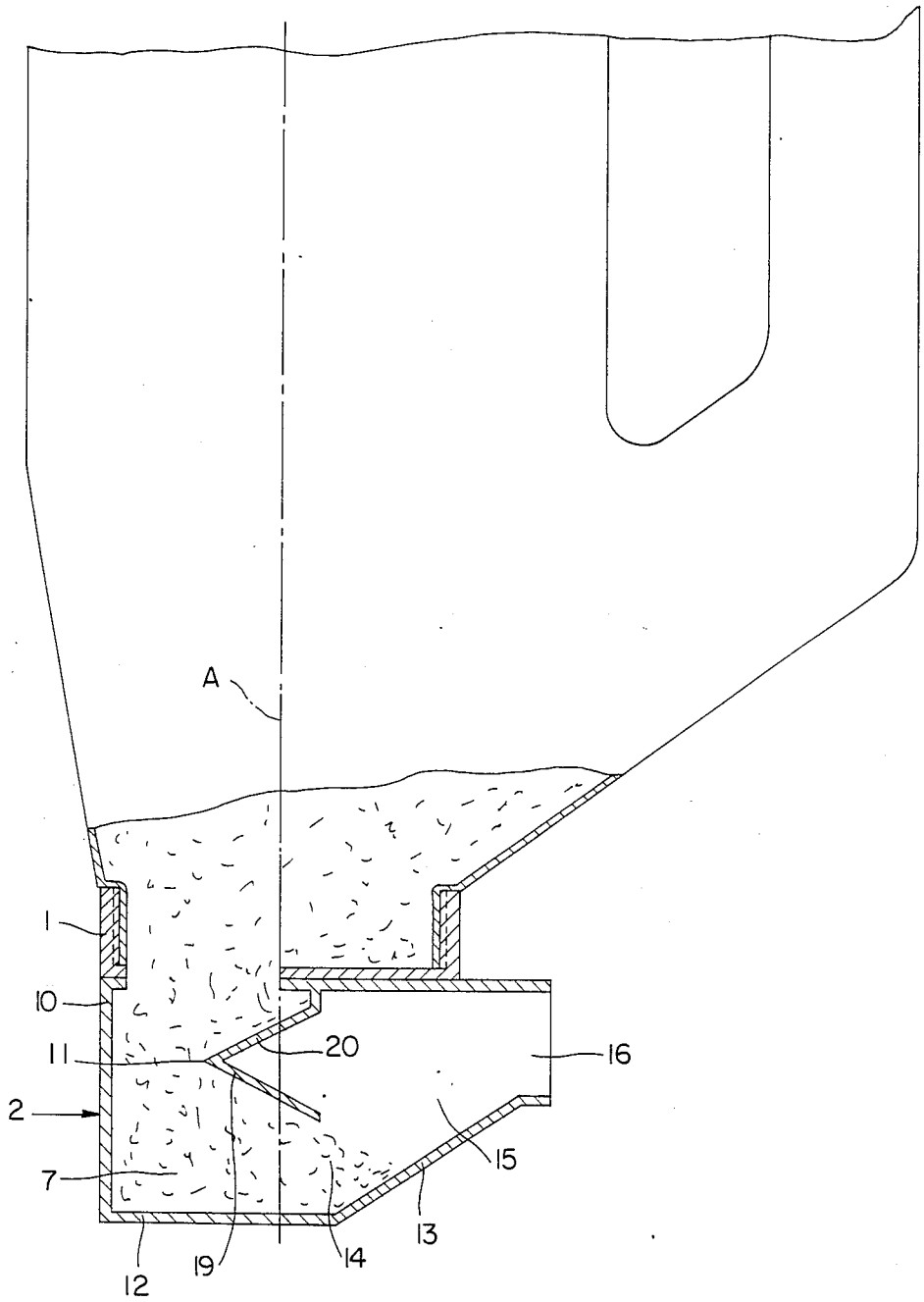
FIG. 5 shows the dispenser illustrated in FIG. 1 in its overhead position.
Figure 6:
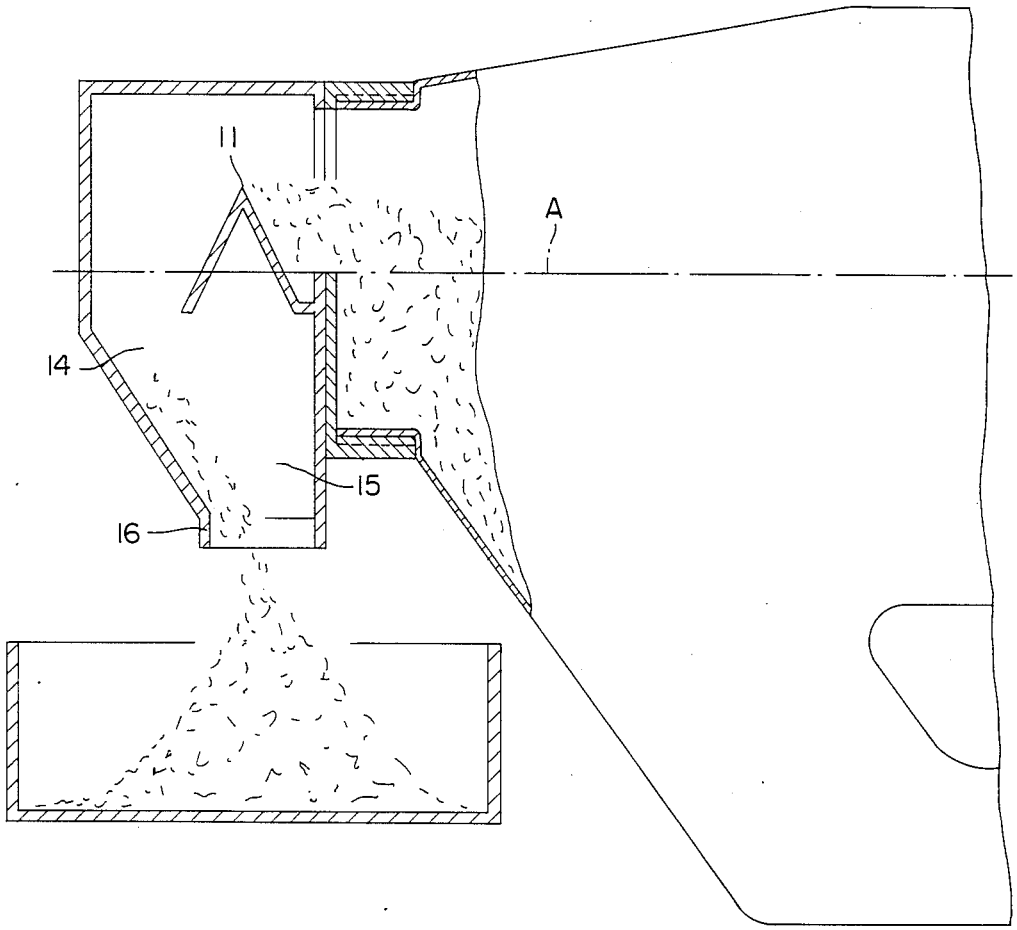
FIG. 6 shows the dispenser illustrated in FIG. 1 in its dispensing position.

An essential feature of the tilting dispenser according to the invention is that the dispensing passage 14 and preferably the nozzle 16 are each positioned at a right angle to the central axis A: operational efficiency of the tilting dispenser according to the invention is further assisted by the fact that, starting from the top wall 12 of the metering chamber 7, the end wall 13 projects through the notional (imaginary) radial plane 17 defined by the free edge 18 of the extension wall 19 of the sliding wall 20 of the web 11. In previous tilting dispensers, the end wall 13 had to extend substantially parallel to the central axis A to guarantee satisfactory dispensing. It is now possible using the V-shaped web 11, to provide an obliquely inclined end wall 13 and, therefore, to enable the metering compartment 7 to be emptied during the first return tilting movement through a dispensing passage 14 and nozzle 16, both extending substantially radially of the central axis A. The operational sequence of this invention is readily seen from FIGS. 5 and 6. In FIG. 5, a container with the inventive dispenser attached has been inverted. As a result, the substance to be dispensed has filled the metering chamber 7, but is held from passing through dispensing passage 14 by gravity, friction, and the like. In FIG. 6, the same container has been tilted back (toward upright) about 90°, so that the dispensing nozzle 16 is aimed downward. As a result, the substance to be dispensed passes, under force of gravity, through dispensing passage 14 and empty space 15, and pours in a metered amount out of nozzle 16. In this position, sliding wall 20 acts to prevent continual pouring.

Figure 7:
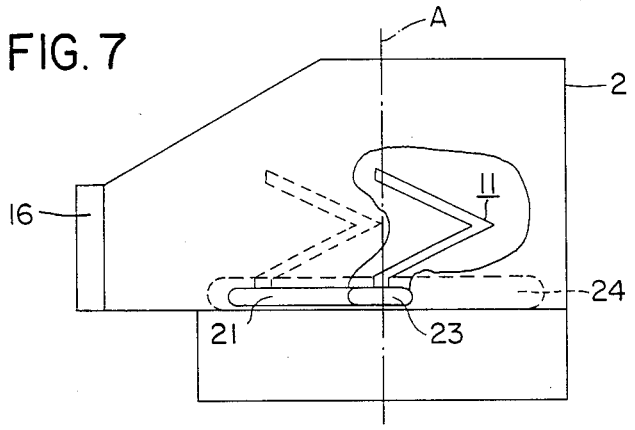
FIG. 7 is a side elevation, partly in section, perpendicularly of the central axis of a dispenser having a variable dispensing volume.
Figure 8:
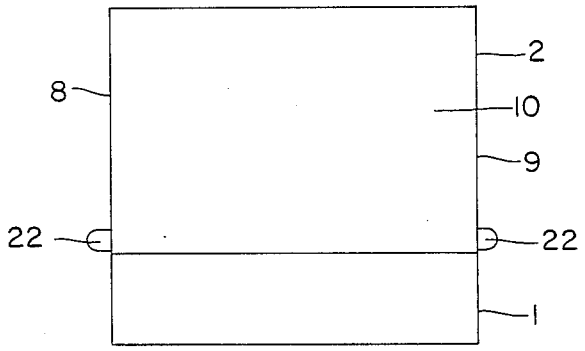
FIG. 8 is a view of the dispenser shown in FIG. 7 toward the rear wall facing the outlet nozzle.

Another embodiment of the dispenser is shown in FIGS. 7 and 8. In this embodiment, the V-shaped web 11 is mounted for radial displacement toward the outlet nozzle 16 between the parallel portions of side walls 8 and 9 to increase or reduce the size of the metering compartment 7. In this way, the user is readily able to adapt the dispensing volume to meet requirements. For example, in the case of laundry detergents, to the different degrees of hardness of the water, volume of the wash load, etc.

In the embodiment shown in FIGS. 7 and 8, the parallel portions of walls 8 and 9 contain guide slots 21 which receive the shoulders 22 of a transverse slide plate 23, to which the web 11 is attached, or with which it is integral. The function of the slide plate 23 is to displace the V-shaped web 11 radially in relation to the central axis A. The slide plate 23 may be actuated by means of the shoulders 22. To seal the guide slots 21, the slide plate 23 may be provided with sealing webs 24 (preferably projecting at a right angle) which bias sealingly against the side walls 8 and 9 from inside.

In still another embodiment (not shown) one or both side walls 8, 9 may be suitably marked along guide slot 21, so that the user may more readily determine the volume to be metered, using the projecting shoulders 22 as indicators.

The housing of the dispenser chamber shown in the drawings need not be restricted to any particular overall geometric configuration. Thus, while the illustrated housing is a rectangular solid with a projecting outlet, the following could also be spherical, egg-shaped, or the like, with suitable adjustment of the baffle and dispensing passage.

In a further embodiment, the web or baffle 11 may be adapted to slide forward toward the outlet passage along guide slots 21 sufficiently to close the container and thus eliminate the need for a cap over the outlet nozzle 16. In such an embodiment, it is necessary that the side walls 8, 9 not taper inward until beyond the point at which the free edge 18 of the web 11 biases against the downward sloping end wall 13. In this instance, the outlet nozzle 16 may be circular in cross-section, as shown in the drawings, or may be a slot.

The dispenser 2 may also be formed integrally with a container and/or integrally with the coupling 1. The coupling 1 may be of any shape in lateral cross section, as long as that shape is adapted to couple to the container opening. A preferred shape is circular, but a square, rectangle, ellipse or other geometric or irregular shape is possible, depending upon the design of the container. When the coupling is not integral with the container, it may be screwed on, snap-fitted, friction-fitted, adhesive bonded, or the like. The coupling 1, dispenser 2, and container may be manufactured of the same or of different materials. The dispenser 2 and coupling 1 are preferably made of plastic, most preferably a thermoplastic.

I claim:

1. A tiliting dispenser for the measured release of a free-flowing solid wherein in use the dispenser is inverted once and the solid is released when the dispenser is tilted about 90° while returning it to its normal upright position, comprising:

an enclosed chamber housing with a base and a vertical inlet opening in said base, and a horizontal discharge outlet whose horizontal central axis is at about a 90° angle to said housing's vertical central axis;

means for flowingly coupling said housing to a container;

baffle means positioned within said chamber between said inlet opening and said discharge outlet and defining first an empty space between said baffle and said discharge outlet, second a metering chamber between said baffle and said inlet opening, and third a dispensing passage between said empty space and said metering chamber; said baffle means being a web comprising a V-shaped trough extending from one side of said housing to the opposite side and mounted on its side so that the inner portion of the trough is pointed at the discharge outlet and partially defines said empty space while the outer portion of the trough is pointed at the rear of said chamber housing and partially defines said metering chamber, and the free edge of said trough partially defines said dispensing passage;

means for horizontal displacement upon which said web is mounted substantially radially in relation to the housing vertical central axis and substantially parallel to the discharge outlet, so that the capacity of the metering chamber may be varied, said displacement means comprising horizontal guide slots in the lower part of each opposed side wall of said chamber housing and an elongated slide plate to which said web is fixed, said plate having two opposed shoulders which project laterally through said respective guide slots, to permit guided horizontal displacement, and said plate having means for sealing those portions of said guide slots not occupied by said shoulders comprising sealing webs mounted on the ends of said slide plate interior of said shoulders and extending parallel to said guide slots;

so that when said tilting dispenser is inverted, said baffle means permits a measured quantitiy of solid to enter and fill said metering chamber and when said dispenser is tilted back about 90° with its discharge outlet pointed downward, only said measured amount flows from said metering chamber through said dispensing passage, into said empty space, and out said discharge outlet.

2. The tilting dispenser of claim 1 wherein said chamber housing comprises a regular parallelepiped with a tapered side projection ending in the discharge outlet, said regular parallelepiped comprising a portion of said base, a rear wall, a top wall, and two opposed side walls, and an open front, said tapered projection extending from said open front and comprising the remaining portion of said base and an end wall which is a cone vertically bisected by the plane of said base and truncated by the plane of said discharge outlet.

3. The tilting dispenser of claim 2 wherein said tapered side projection passes through and extends beyond the notional plane defined by the free edge of said web and parallel to said base.

4. The tilting dispenser of claim 3 wherein said discharge outlet comprises a cylindrical outlet nozzle adapted to receive a closure cap.

5. The tilting dispenser of claim 1 wherein said chamber housing comprises a spheroid with a tapered side projection ending in the discharge outlet, which spheroid and projection are both bisected by said base.

6. The tilting dispenser of claim 1 wherein said coupling means comprises a lid having a head connected to said housing base with an aperture corresponding to the base inlet opening, and a peripheral downward extending wall adapted to fit a container outlet.

7. The tilting dispenser of claim 6 wherein said coupling means is circular in horizontal cross-section and has a screw thread in its downward extending wall.

8. The tilting dispenser of claim 7 wherein said coupling means is rotatably attached to said chamber housing by means of a pivot located at their common vertical central axes.

9. The tilting dispenser of claim 6 wherein said coupling means is integral with said chamber housing.

10. The tilting dispenser of claim 6 wherein said coupling means is rotatably attached to said chamber housing by means of a pivot located at their common vertical central axes.

* * * * *